US008723751B2

(12) United States Patent
Hung et al.

(10) Patent No.: US 8,723,751 B2
(45) Date of Patent: May 13, 2014

(54) ANTENNA SYSTEM WITH PLANAR DIPOLE ANTENNAS AND ELECTRONIC APPARATUS HAVING THE SAME

(75) Inventors: Tzu-Chieh Hung, Taipei (TW); Saou-Wen Su, Taipei (TW)

(73) Assignees: Lite-On Electronics (Guangzhou) Limited, Guangzhou (CN); Lite-On Technology Corp., Taipei (TW)

( * ) Notice: Subject to any disclaimer, the term of this patent is extended or adjusted under 35 U.S.C. 154(b) by 424 days.

(21) Appl. No.: 13/083,930

(22) Filed: Apr. 11, 2011

(65) Prior Publication Data

US 2012/0062437 A1 Mar. 15, 2012

(30) Foreign Application Priority Data

Sep. 14, 2010 (CN) ..... 2010 1 0282201

(51) Int. Cl.
*H01Q 21/20* (2006.01)

(52) U.S. Cl.
USPC ..... 343/799; 343/795

(58) Field of Classification Search
USPC ..... 343/799, 795, 797
See application file for complete search history.

(56) References Cited

U.S. PATENT DOCUMENTS

| | | | | |
|---|---|---|---|---|
| 7,495,627 | B2 * | 2/2009 | Parsche | 343/800 |
| 8,188,934 | B2 * | 5/2012 | Haapala et al. | 343/803 |
| 2007/0268185 | A1 * | 11/2007 | Teshima et al. | 343/700 MS |
| 2012/0146869 | A1 * | 6/2012 | Holland et al. | 343/795 |

* cited by examiner

*Primary Examiner* — Ahshik Kim
(74) *Attorney, Agent, or Firm* — Rosenberg, Klein & Lee

(57) ABSTRACT

An antenna system includes: and antenna module and a system module. The antenna module includes a substrate, and a plurality of planar dipole antennas each including a short-circuit section, two first radiator sections operable in a first frequency band and connected to the short-circuit section, and two second radiator sections operable in a second frequency band and connected to the short-circuit section. The planar dipole antennas are arranged such that geometric centers thereof are respectively spaced apart from a center point bounded by the planar dipole antennas by a predetermined distance, such that each of the planar dipole antennas is spaced apart from an adjacent one of the planar dipole antennas by a predetermined minimum distance. The system module has a grounding plane that faces toward and that is spaced apart from and parallel to the substrate.

20 Claims, 9 Drawing Sheets

ANTENNA SYSTEM WITH PLANAR DIPOLE ANTENNAS AND ELECTRONIC APPARATUS HAVING THE SAME

CROSS-REFERENCE TO RELATED APPLICATION

This application claims priority of Chinese Application No. 201010282201.7, filed on Sep. 14, 2010.

BACKGROUND OF THE INVENTION

1. Field of the Invention

The present invention relates to an antenna system and an electronic apparatus having the same, more particularly to an antenna system with multiple planar dipole antennas and an electronic apparatus having the same.

2. Description of the Related Art

Most modern wireless network products, such as wireless access points, are compact and lightweight. Therefore, how to reduce space occupied by antennas in the wireless network products without significant adverse impact to antenna performance is always among the subjects of endeavor in the antenna industry.

Conventional monopole antennas, such as one disclosed in Taiwanese patent No. M377714, are bulky and require electrical connection to additional grounding planes. On the other hand, fabrication of antennas with three-dimensional metal structures generally involves multiple bending processes, which can be time-consuming and costly. In addition, planar inverted-F antennas generally have a relatively poor range of gain values (typically about 3 dBi at 2.4 GHz and 4 dBi at 5 GHz), and are characterized by non-broadside radiation (i.e., poor radiation directivity).

SUMMARY OF THE INVENTION

Therefore, an object of the present invention is to provide a multi-band antenna system with high directionality and high gain.

Another object of the present invention is to provide an antenna system that is small and low cost, that has a low profile, and that is suitable for application to small wireless network products.

Accordingly, an antenna system of the present invention includes an antenna module and a system module.

The antenna module includes a substrate including opposite first and second surfaces, and a plurality of planar dipole antennas disposed on the first surface of the substrate. Each of the planar dipole antennas includes a short-circuit section that has a grounding segment and two sides, a pair of first radiator sections that are operable in a first frequency band and that are connected electrically and respectively to the two sides of the short-circuit section, and a pair of second radiator sections that are operable in a second frequency band. Each of the second radiator sections has a feed-in portion and an extending portion, the feed-in portion being connected electrically to the short-circuit section and having a distal end distal from the short-circuit section, the extending portion extending from the distal end of the feed-in portion of the respective one of the second radiator sections. One of the second radiator sections of each of the planar dipole antennas has a feed-in segment. The planar dipole antennas are arranged such that geometric centers of the planar dipole antennas are respectively spaced apart from a center point bounded by the planar dipole antennas by a predetermined distance, such that each of the planar dipole antennas is spaced apart from an adjacent one of the planar dipole antennas by a predetermined minimum distance, and such that, for each of the planar dipole antennas, the feed-in segment, the grounding segment, and the center point are disposed on a same line.

The system module has a grounding plane that faces toward and that is spaced apart from and parallel to the second surface of the substrate.

A further object of the present invention is to provide an electronic apparatus including an antenna module and a system module.

Accordingly, an electronic apparatus of the present invention includes a housing, and an antenna module and a system module disposed in the housing.

The antenna module includes a substrate including opposite first and second surfaces, and a plurality of planar dipole antennas disposed on the first surface of the substrate. Each of the planar dipole antennas includes a short-circuit section that has a grounding segment and two sides, a pair of first radiator sections that are operable in a first frequency band and that are connected electrically and respectively to the two sides of the short-circuit section, and a pair of second radiator sections that are operable in a second frequency band. Each of the second radiator sections has a feed-in portion and an extending portion, the feed-in portion being connected electrically to the short-circuit section and having a distal end distal from the short-circuit section, the extending portion extending from the distal end of the feed-in portion of the respective one of the second radiator sections. One of the second radiator sections of each of the planar dipole antennas has a feed-in segment. The planar dipole antennas are arranged such that geometric centers of the planar dipole antennas are respectively spaced apart from a center point bounded by the planar dipole antennas by a predetermined distance, such that each of the planar dipole antennas is spaced apart from an adjacent one of the planar dipole antennas by a predetermined minimum distance, and such that, for each of the planar dipole antennas, the feed-in segment, the grounding segment, and the center point are disposed on a same line.

The system module has a grounding plane that faces toward and that is spaced apart from and parallel to the second surface of the substrate.

BRIEF DESCRIPTION OF THE DRAWINGS

The Patent Application file contains at least one Drawing executed in color. Copies of this Patent or Patent Application Publication with the color drawings will be provided by the Office upon request and payment of the necessary fee.

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
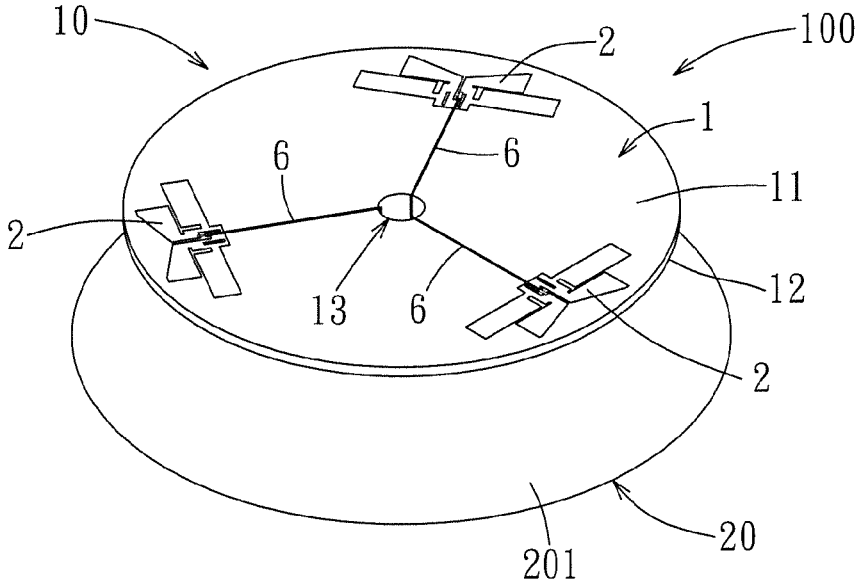
FIG. 1 is a perspective view of the preferred embodiment of an antenna system according to the present invention.

Referring to FIG. 1, the preferred embodiment of a multi-antenna system 100 according to the present invention is a planar antenna system operable in first and second frequency bands ranging from 2400 MHz to 2484 MHz and from 5150 MHz to 5825 MHz, respectively, is preferably fabricated using printed circuit board (PCB) techniques, and includes an antenna module 10 and a system module 20.

The antenna module 10 includes a substrate 1 and a plurality of planar dipole antennas 2. In this embodiment, the substrate 1 includes opposite first and second surfaces 11, 12, is formed with a through hole 13 for extension of signal-feed cables 6 therethrough, and is preferably made of dielectric materials, such as glass fiber (FR4). In addition, the antenna module 10 includes three planar dipole antennas 2 each being a half-wavelength dipole antenna. However, configuration of the planar dipole antennas 2 may be otherwise in other embodiments. Although the substrate 1 of this embodiment is a circular substrate, configuration of the substrate 1 is not limited to such.

Figure 2:
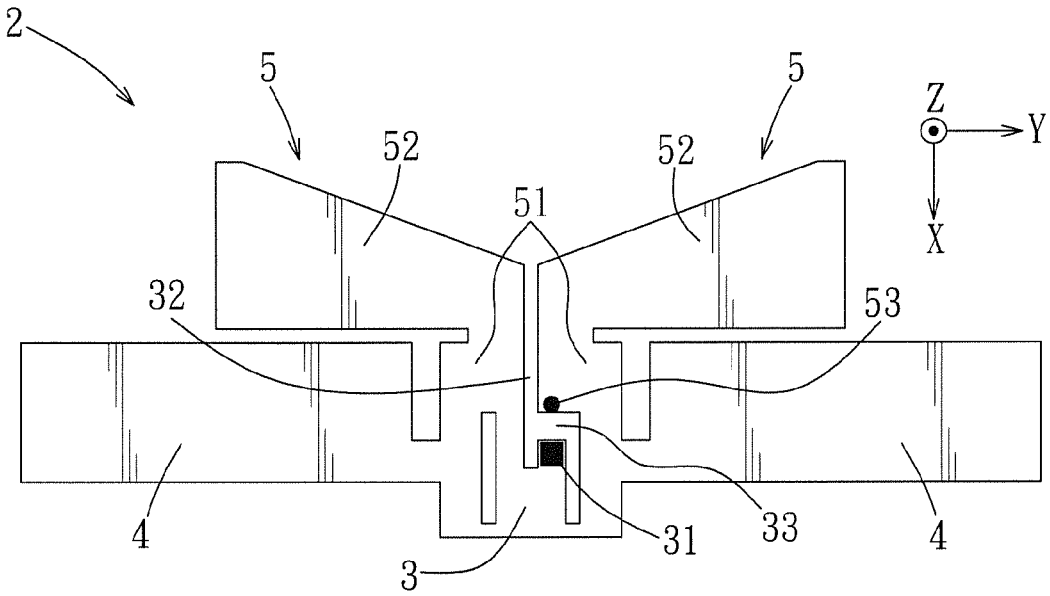
FIG. 2 is a schematic diagram of a planar dipole antenna of the antenna system.

Referring to FIGS. 1 and 2, each of the planar dipole antennas 2 is disposed on the first surface 11, and includes a short-circuit section 3, a pair of first radiator sections 4 operable in the first frequency band, and a pair of second radiator sections 5 operable in the second frequency band. In this embodiment, the first radiator sections 4 operate in 2.4 GHz, and the second radiator sections 5 operates in 5 GHz. Each first radiator section 4 has a length longer than that of each second radiator section 5.

For each of the planar dipole antennas 2: the first radiator sections 4 extend in an extending direction and are connected electrically and respectively to two sides of the short-circuit section 3; the short-circuit section 3 extends substantially parallel to the extending direction, has a grounding segment 31, and is disposed on a first side of the first radiator sections 4; and the second radiator section 5 have extending portions 52 that extend substantially parallel to the extending direction and that are disposed on a second side of the first radiator sections 4 opposite to the first side.

For each of the planar dipole antennas 2, each of the second radiator sections 5 further has a feed-in portion 51 that is connected electrically to the short-circuit section 3 and that has a distal end distal from the short-circuit section 3. The extending portion 52 of each second radiator section 5 extends from the distal end of the respective feed-in portion 51. The feed-in portion 51 of one of the second radiator sections 5 of each of the planar dipole antennas 2 has a feed-in segment 53 disposed thereon. It is to be noted that, for each of the planar dipole antennas 2, the extending portions 52 of second radiator sections 5 and the first radiator sections 4 are connected electrically to the feed-in portion 51.

For each of the planar dipole antennas 2, the feed-in portions 51 are spaced apart from each other by a first gap 32, the feed-in segment 53 and the grounding segment 31 are spaced apart from each other by a second gap 33, and the first and second gaps 32, 33 are in spatial communication with each other.

Through disposing the planar dipole antennas 2 on the first surface 11 of the substrate 1 using PCB techniques, fabrication costs can be lower. Moreover, through adjusting the second gap 33 and the short-circuit section 3 of each of the planar dipole antennas 2, the antenna module 10 maybe configured to exhibit a balanced relationship between capacitive reactance and inductive reactance, thereby achieving an ideal impedance bandwidth in each of the first and second frequency bands.

In this embodiment, for each of the second radiator sections 5 of each of the planar dipole antennas 2, the extending portion 52 has a first end connected electrically to the distal end of the feed-in portion 51, a second end distal from the distal end of the feed-in portion 51, and a width that increases gradually from the first end to the second end. Such a configuration ensures that the second radiator sections 5 have a relatively wide operating bandwidth. However, configuration of the planar dipole antennas 2 is not limited to such. Specifically, referring to FIGS. 3 to 5, in each of modifications of the planar dipole antenna 2, the extending portion 52 of the second radiators 5 may have the shape of any other triangle, and the feed-in segment 53 and the grounding segment 31 may be disposed otherwise.

Figure 3:
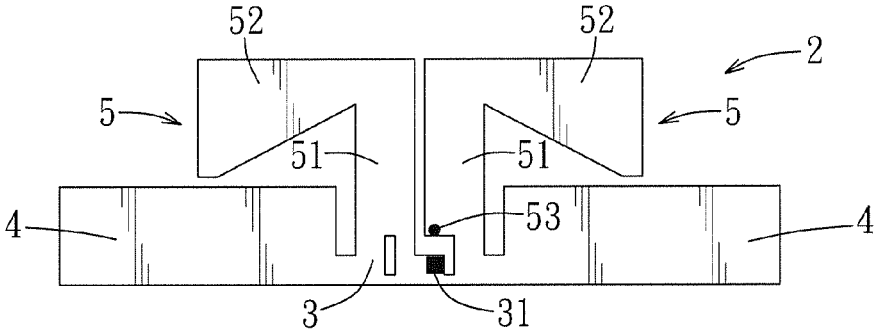
FIGS. 3 to 5 are schematic diagrams of modifications of the planar dipole antenna, respectively, according to the present invention.
Figure 4:
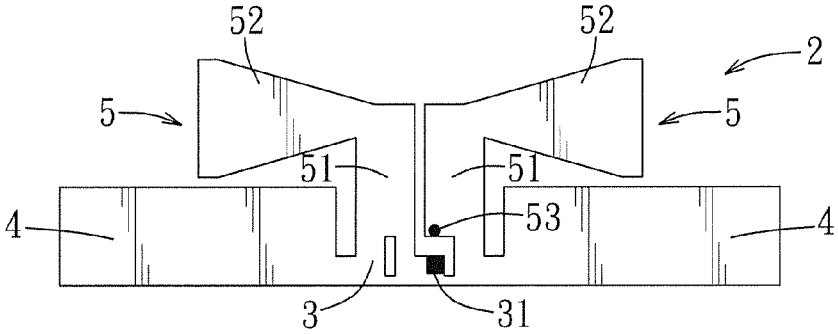
Figure 5:
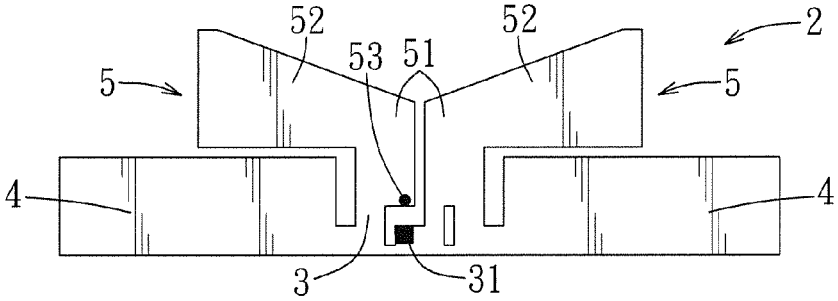

It is to be noted that, in contrast to the planar dipole antenna 2 of the preferred embodiment shown in FIG. 2, the short-circuit section 3 of the planar dipole antenna 2 of each of the modifications respectively shown in FIGS. 3, 4 and 5 has one side flush with the first side of the first radiator sections 4 such that each of the first radiator sections 4 is relatively long in physical length, which enables the planar dipole antenna 2 to have a resonant length of one-half a wavelength and to exhibit a relatively ideal impedance bandwidth in each of the first and second frequency bands.

Figure 6:
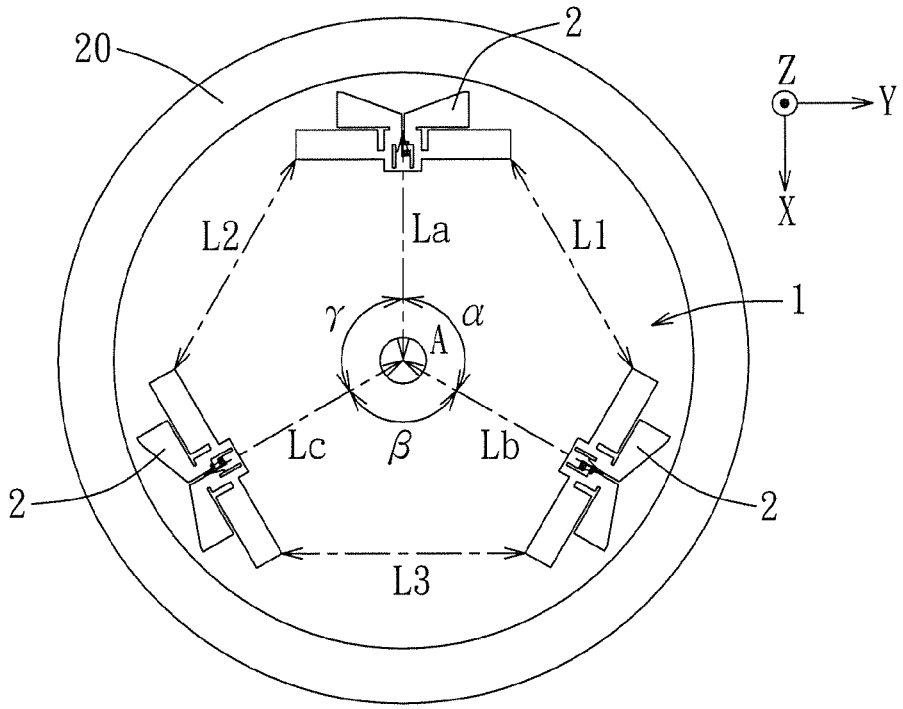
FIG. 6 is a schematic diagram of the antenna system.

Referring to FIG. 6, the three planar dipole antennas 2 of this embodiment are arranged: such that geometric centers of the planar dipole antennas 2 are respectively spaced apart from a center point "A" bounded by the planar dipole antennas 2 by a predetermined distance "La", "Lb", "Lc", wherein La=Lb=Lc; such that each of the planar dipole antennas 2 is spaced apart from an adjacent one of the planar dipole antennas 2 by a predetermined minimum distance "L1", "L2", "L3", wherein L1=L2=L3; such that each of extending lines extending from the geometric centers of the planar dipole antennas 2 to the center point "A" forms a predetermined angle "α", "β", "γ" with an adjacent one of the extending lines, wherein α=β=γ and are 120° in this embodiment; and such that, for each of the planar dipole antennas 2, the feed-in segment 53, the grounding segment 31, and the center point "A" are disposed on a same line. For each of the planar dipole antennas 2, the short-circuit section 3 extends substantially perpendicular to the line interconnecting the center point "A", the feed-in segment 53, and the grounding segment 31. Thus, each of the signal-feed cables 6, which extend respectively from the through hole 13 (i.e., from the center point "A") to the feed-in segment 53 and the grounding segment 31 of a respective one of the planar dipole antennas 2, may be kept from overlapping with the first and second radiator sections 4, 5 of the respective one of the planar dipole antennas 2, thereby reducing interference between the signal-feed cables 6 and the planar dipole antennas 2. In this embodiment, the dipole planar antennas 2 are arranged symmetrically about the center point "A" and arranged along respective peripheral edges of the substrate 1.

By virtue of the symmetrical structure of the antenna module 10, mutual coupling among the planar dipole antennas 2 may be reduced, and the same extent of isolation may be ensured for the planar dipole antennas 2. Furthermore, the multi-antenna system 100 is thus able to achieve a symmetrical radiation/communication coverage space.

The system module 20 is a system circuit board having a grounding plane 201 (e.g., a metal plane) that faces toward and that is spaced apart from and parallel to the second surface 12 of the substrate 1 such that the grounding plane 201 is able to reflect radiation from the antenna module 10. Radiation patterns of the multi-antenna system 100 thus exhibit high directivity and gain. Moreover, the system module 20 preferably has a multi-layer structure, of which the top layer is a thin metal layer serving as the grounding plane 201, and each of remaining layers is independently one of a dielectric layer and a circuit layer. It is to be noted that, in other embodiments, the antenna module 10 and the system module 20 may be spaced apart from each other so as to enable disposing of various electronic components therebetween. Furthermore, the substrate 1 occupies an area not larger than that occupied by the system module 20 such that the system module 20 is able to substantially reflect signals radiated by the planar dipole antennas 2.

Figure 7:
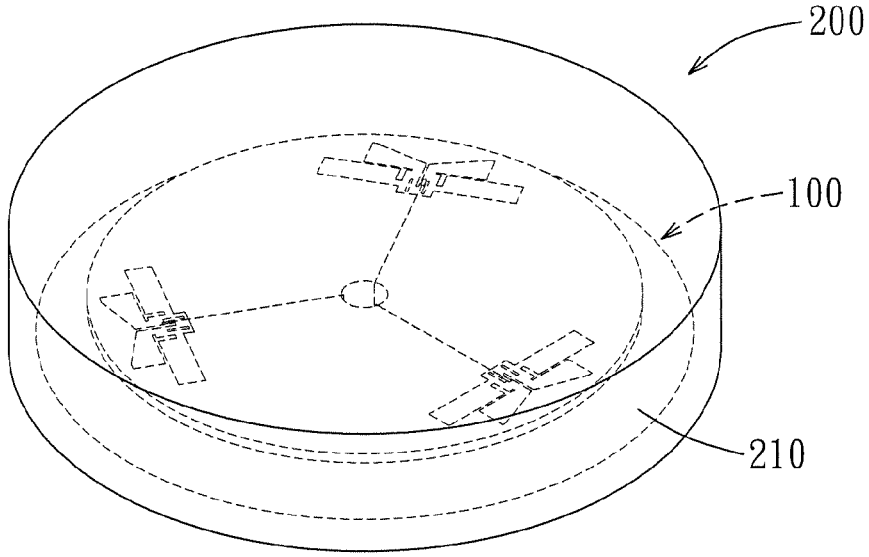
FIG. 7 is a perspective view of an electronic apparatus including a housing and the antenna system disposed therein.

Referring to FIG. 7, the multi-antenna system 100 may be disposed in a housing 210 of an electronic apparatus 200, which may be a wireless access point or a wireless router. Each of the signal-feed cables 6 is preferably a mini-coaxial cable connected electrically to the feed-in segment 53 of the respective planar dipole antenna 2 for transmission and reception of signals therethrough.

Figure 8:
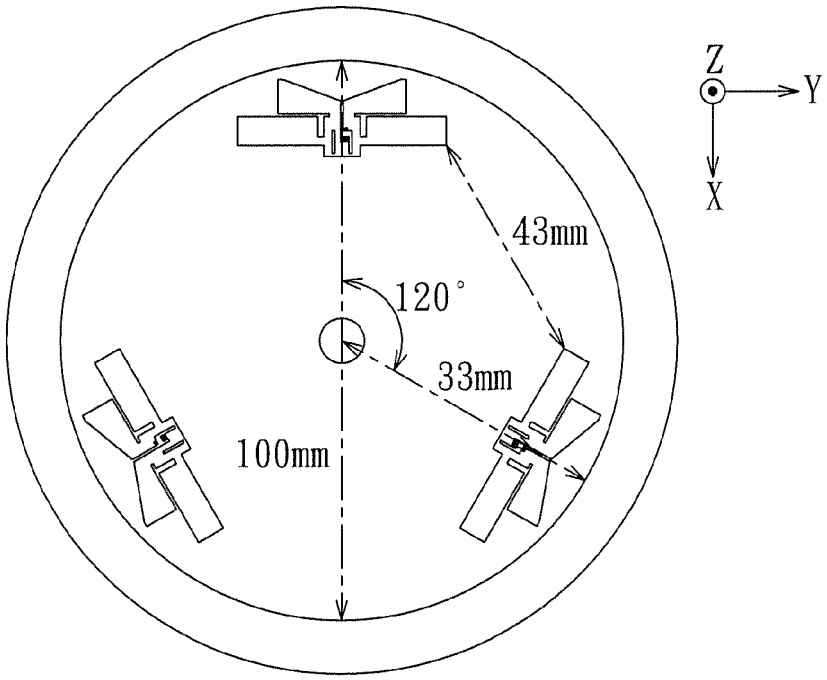
FIG. 8 is another schematic diagram of the antenna system to illustrate dimensions thereof.
Figure 9:
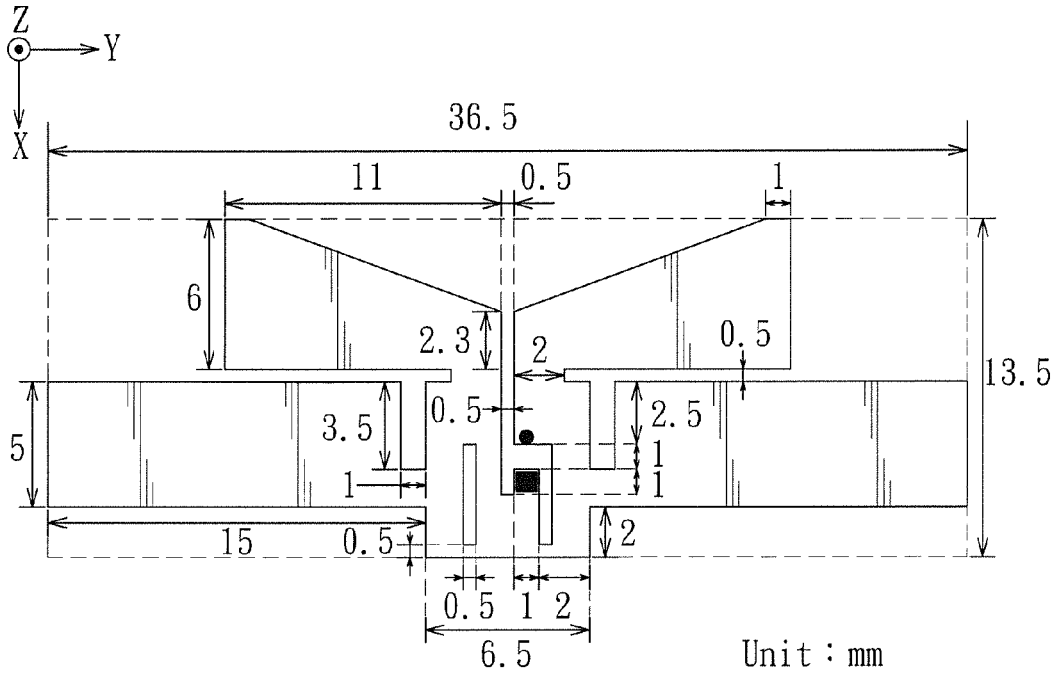
FIG. 9 is another schematic diagram of the planar dipole antenna to illustrate dimensions thereof.
Figure 10:
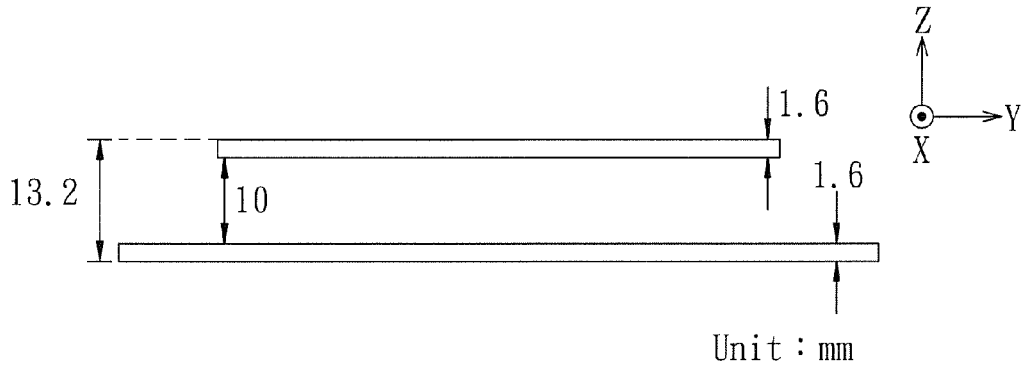
FIG. 10 is yet another schematic diagram of the antenna system to illustrate thickness of the antenna system.

FIG. 8 shows dimensions of the multi-antenna system 100 viewed from the top. FIG. 9 shows dimensions of the planar dipole antenna 2. FIG. 10 shows dimensions of the multi-antenna system 100 viewed from the side. It is apparent that the planar dipole antenna 2 has dimensions of 13.5×36.5 $mm^2$, that the predetermined angle is 120 degrees, that the antenna module 10 is spaced apart from the system module 20 by a space ranging from 5 mm to 10 mm, and that the extending portion 52 of each of the second radiator sections 5 and a corresponding one of the first radiator sections 4 of each of the dipole planar antennas 2 are spaced apart from each other by a space ranging from 0.5 mm to 1.5 mm. However, the low-profile stacked configuration of the multi-antenna system 100 is not limited to such. It is to be noted that thickness of the planar dipole antenna 2 and that of the grounding plane 201 are insignificant relative to thickness of the substrate 1 and that of the system module 20. Hence, the planar dipole antennas 2 and the grounding plane 201 are omitted in FIG. 10.

Figure 11:
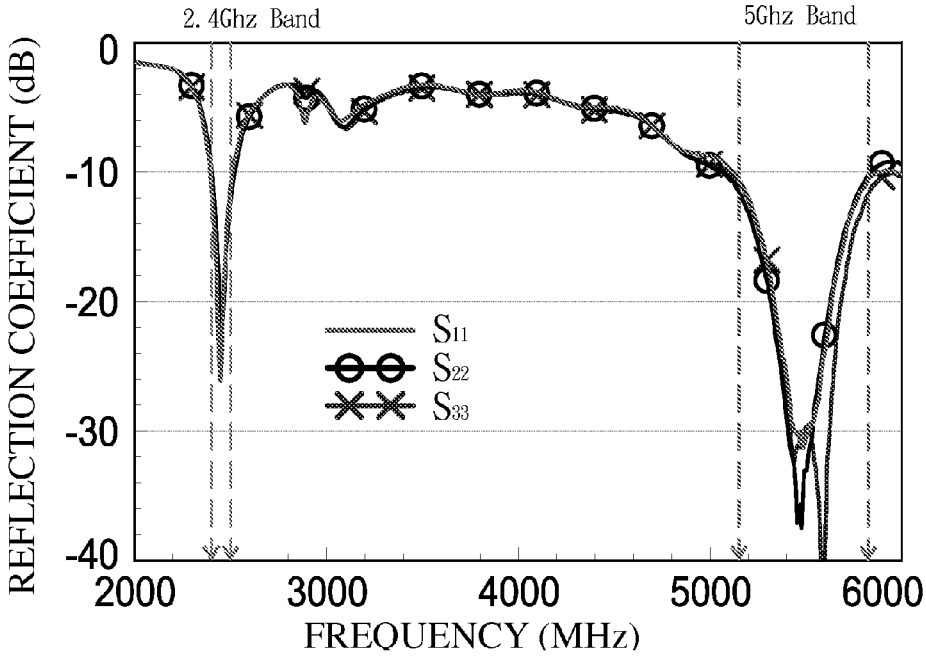
FIG. 11 is a plot of reflection coefficient of the antenna system.

FIG. 11 shows a plot of reflection coefficient, of which "$S_{11}$", "$S_{22}$", and "$S_{33}$" represent reflection coefficients of the three planar dipole antennas 2, respectively. It is apparent that the reflection coefficients of the planar dipole antennas 2 are lower than −10 dB in the first and second frequency bands.

Figure 12:
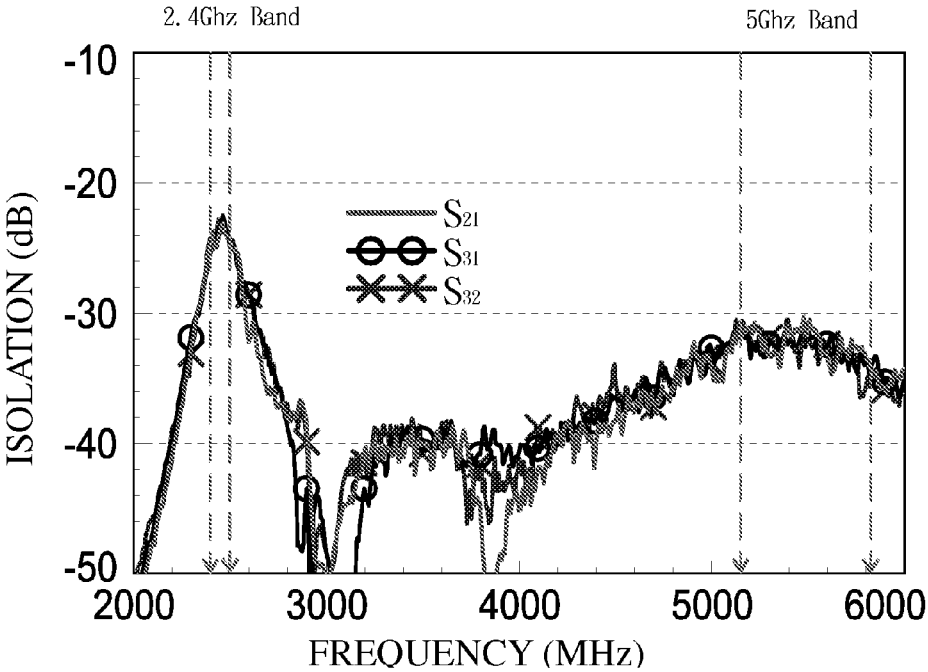
FIG. 12 is a plot of isolation of the antenna system.

FIG. 12 shows a plot of isolation, of which "$S_{21}$", "$S_{31}$", and "$S_{32}$" represent isolations between different pairs of the three planar dipole antennas 2, respectively. It is apparent that an average value of the isolations among the planar dipole antennas 2 is below −20 dB in the first and second frequency bands.

Figure 13:
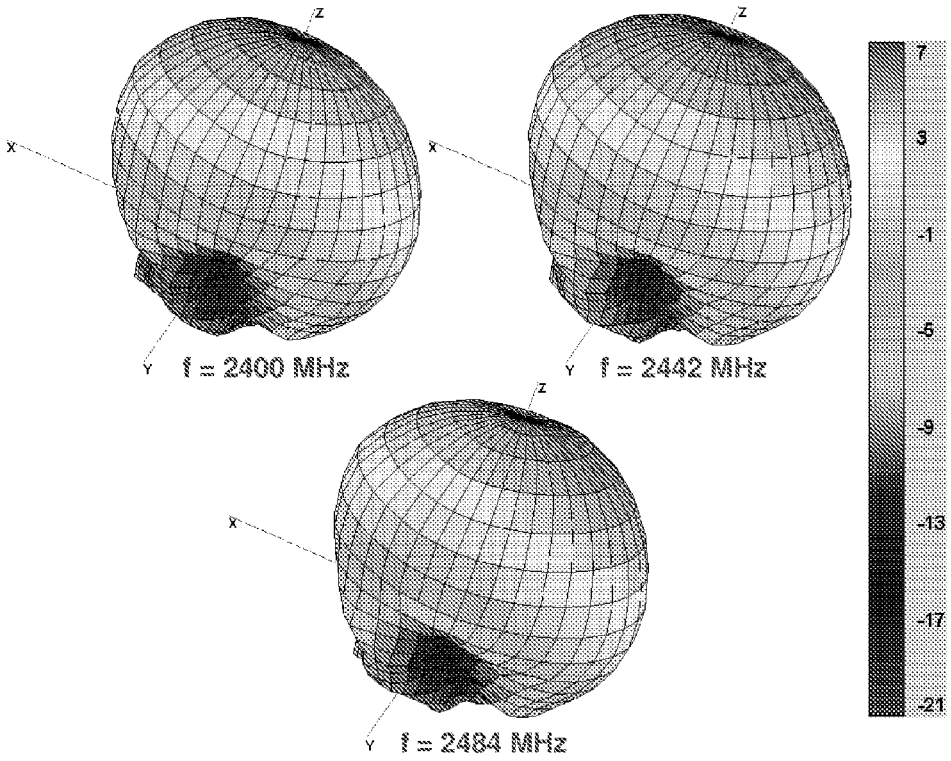
FIG. 13 shows three-dimensional radiation patterns of the antenna system at 2400 MHz, 2442 MHz, and 2484 MHz, respectively.
Figure 14:
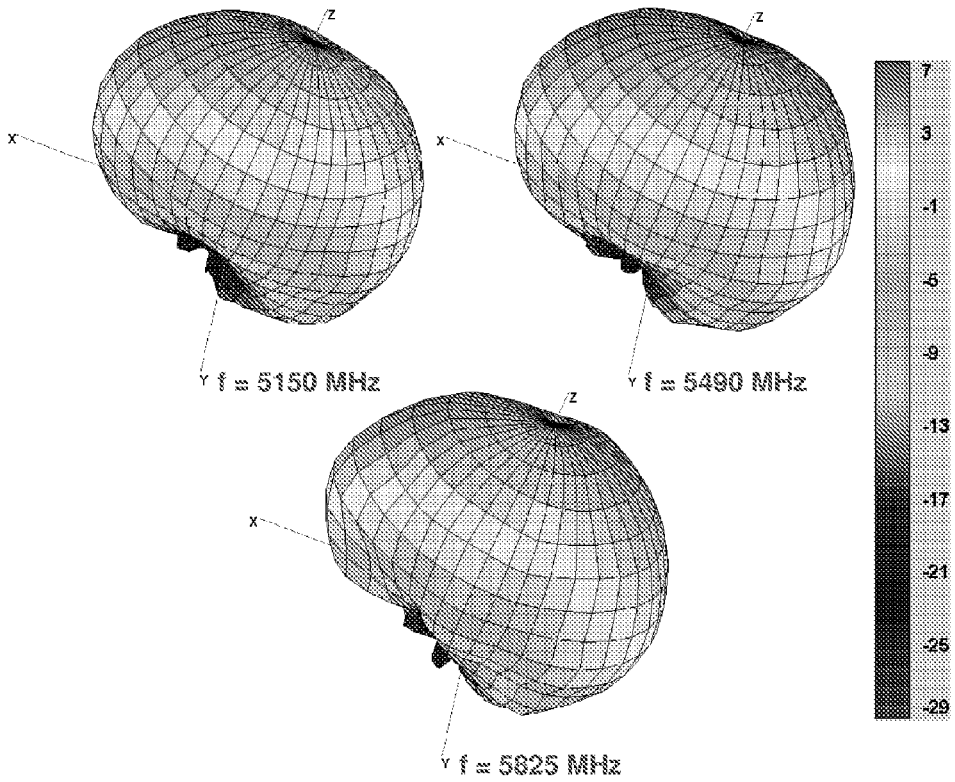
FIG. 14 shows three-dimensional radiation patterns of the antenna system at 5150 MHz, 5490 MHz, and 5825 MHz, respectively.

FIG. 13 shows three-dimensional radiation patterns of the multi-antenna system 100 at 2400 MHz, 2442 MHz, and 2484 MHz, respectively. FIG. 14 shows three-dimensional radiation patterns of the multi-antenna system 100 at 5150 MHz, 5490 MHz, and 5825 MHz, respectively. The multi-antenna system 100 has half-power beamwidths (HPBW) of 99° and 106° in the first and second frequency bands, respectively. Such a result confirms that the multi-antenna system 100 exhibits high-directivity, high-gain radiation patterns.

Figure 15:
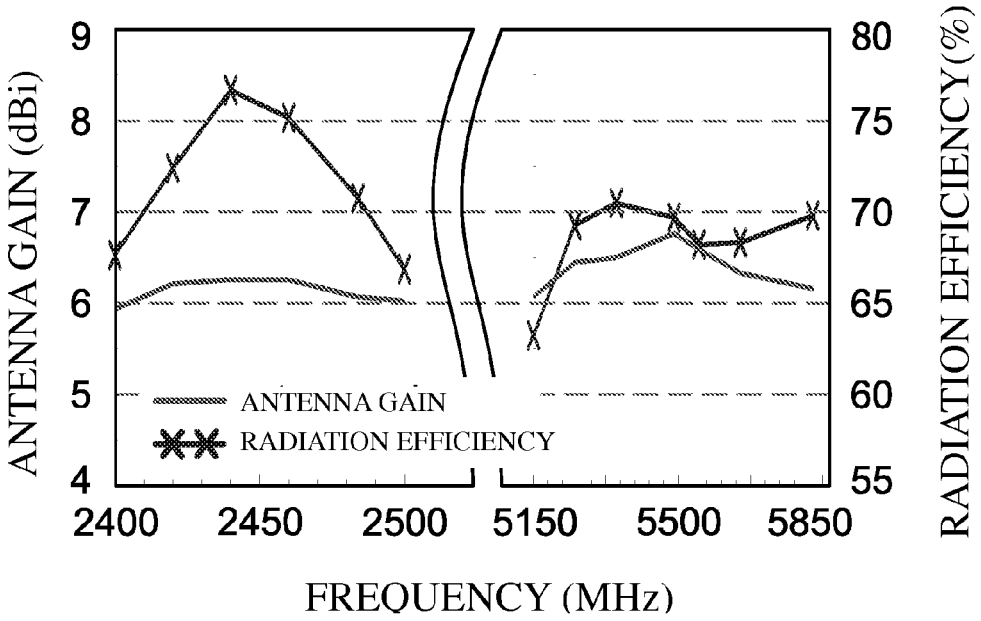
FIG. 15 is a plot showing gain value and radiation efficiencies of the antenna system at different frequencies.

FIG. 15 shows a plot of radiation efficiency (%) and antenna gain (dBi) of the multi-antenna system 100. It is apparent that the multi-antenna system 100 has a maximum gain above 6 dBi and radiation efficiencies above 60% in the first and second frequency bands.

Referring again to FIG. 1, unlike conventional antennas with three-dimensional structures, the multi-antenna system 100 of the preferred embodiment is able to radiate signals with high directivity in a direction from the system module 20 to the antenna module 10 without connection to an additional antenna grounding plane. Moreover, the multi-antenna system 100 has half-power beamwidths (HPBW) of 99° and 106° in the first and second frequency bands, respectively, and a relatively high gain and a front-to-back ratio of nearly 20 dB in the first and second frequency bands.

In summary, the multi-antenna system 100 is operable in the 2.4/5 GHz wireless local area network frequency bands, radiates signals with high directivity and high gain, and is characterized by relatively high isolation. Impedance matching of the multi-antenna system 100 may be adjusted through adjusting the second gap 33 and the short-circuit section 3. In addition, the planar dipole antennas 2 are arranged such that the signal-feed cables 6 may be kept from overlapping with the planar dipole antennas 2, thereby reducing interference therebetween. Moreover, the system module 20 is able to improve directivity of signals radiated by the antenna module 10.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. An antenna system comprising:

an antenna module including a substrate including opposite first and second surfaces, and a plurality of planar dipole antennas disposed on said first surface of said substrate, each of said planar dipole antennas including a short-circuit section that has a grounding segment and two sides, a pair of first radiator sections that are operable in a first frequency band and that are connected electrically and respectively to said two sides of said short-circuit section, and a pair of second radiator sections that are operable in a second frequency band, each of said second radiator sections having a feed-in portion and an extending portion, said feed-in portion being connected electrically to said short-circuit section and having a distal end distal from said short-circuit section, said extending portion extending from said distal end of said feed-in portion of the respective one of said second radiator sections, one of said second radiator sections of each of said planar dipole antennas having a feed-in segment, said planar dipole antennas being arranged such that geometric centers of said planar dipole antennas are respectively spaced apart from a center point bounded by said planar dipole antennas by a predetermined distance, such that each of said planar dipole antennas is spaced apart from an adjacent one of said planar dipole antennas by a predetermined minimum distance, and such that, for each of said planar dipole antennas, said feed-in segment, said grounding segment, and said center point are disposed on a same line; and a system module having a grounding plane that faces toward and that is spaced apart from and parallel to said second surface of said substrate.

2. The antenna system as claimed in claim 1, wherein, for each of said planar dipole antennas, said first radiator sections extend in an extending direction, said short-circuit section extends substantially parallel to the extending direction and is disposed on a first side of said first radiator sections, and said extending portions of said second radiator sections extend substantially parallel to the extending direction and are disposed on a second side of said first radiator sections opposite to said first side.

3. The antenna system as claimed in claim 2, wherein, for each of said planar dipole antennas, said feed-in segment is disposed on said feed-in portion of said one of said second radiator sections.

4. The antenna system as claimed in claim 2, wherein, for each of said planar dipole antennas, said short-circuit section further extends substantially perpendicular to the line on which said center point, said feed-in segment and said grounding segment are disposed.

5. The antenna system as claimed in claim 2, wherein said short-circuit section of said planar dipole antenna has one side flush with said first side of said first radiator sections.

6. The antenna system as claimed in claim 1, wherein said planar dipole antennas are symmetrically arranged about said center point and along respective peripheral sides of said substrate.

7. The antenna system as claimed in claim 6, wherein each of extending lines extending respectively from said geometric centers of said planar dipole antennas to said center point forms a predetermined angle with an adjacent one of said extending lines.

8. The antenna system as claimed in claim 7, wherein said antenna module includes three of said planar dipole antennas, and the predetermined angle is 120 degrees.

9. The antenna system as claimed in claim 1, wherein, for each of said planar dipole antennas, said feed-in portions of said second radiator sections are spaced apart from each other by a first gap, said feed-in segment and said grounding segment are spaced apart from each other by a second gap, and said first and second gaps are in spatial communication with each other.

10. The antenna system as claimed in claim 1, wherein, for each of said second radiator sections of each of said planar dipole antennas, said extending portion has a first end connected electrically to said distal end of said feed-in portion, and a second end distal from said distal end of said feed-in portion, said extending portion further having a width that increases gradually from one of said first and second ends to the other of said first and second ends.

11. The antenna system as claimed in claim 10, wherein said second end of said extending portion is wider than said first end of said extending portion.

12. The antenna system as claimed in claim 1, wherein said substrate is formed with a through hole that coincides with said center point so as to permit extension of signal-feed cables therethrough.

13. The antenna system as claimed in claim 1, wherein said substrate occupies an area not larger than that occupied by said system module.

14. The antenna system as claimed in claim 1, wherein said substrate is made of a dielectric material.

15. The antenna system as claimed in claim 1, wherein said system module is a system circuit board.

16. The antenna system as claimed in claim 1, wherein said grounding plane of said system module is disposed such that said grounding plane of said system module is able to reflect radiation from said antenna module.

17. An electronic apparatus comprising a housing, and an antenna module and a system module disposed in said housing, said antenna module including a substrate including opposite first and second surfaces, and a plurality of planar dipole antennas disposed on said first surface of said substrate, each of said planar dipole antennas including a short-circuit section that has a grounding segment and two sides, a pair of first radiator sections that are operable in a first frequency band and that are connected electrically and respectively to said two sides of said short-circuit section, and a pair of second radiator sections that are operable in a second frequency band, each of said second radiator sections having a feed-in portion and an extending portion, said feed-in portion being connected electrically to said short-circuit section and having a distal end distal from said short-circuit section, said extending portion extending from said distal end of said feed-in portion of the respective one of said second radiator sections, one of said second radiator sections of each of said planar dipole antennas having a feed-in segment, said planar dipole antennas being arranged such that geometric centers of said planar dipole antennas are respectively spaced apart from a center point bounded by said planar dipole antennas by a predetermined distance, such that each of said planar dipole antennas is spaced apart from an adjacent one of said planar dipole antennas by a predetermined minimum distance, and such that, for each of said planar dipole antennas, said feed-in segment, said grounding segment, and said center point are disposed on a same line, said system module having a grounding plane that faces toward and that is spaced apart from and parallel to said second surface of said substrate.

18. The electronic apparatus as claimed in claim 17, wherein said antenna module and said system module are spaced apart from each other so as to enable disposing of various electronic components therebetween.

19. The electronic apparatus as claimed in claim 17, wherein said electronic apparatus is an access point.

20. The electronic apparatus as claimed in claim 17, wherein said grounding plane of said system module is disposed such that said grounding plane of said system module is able to reflect radiation from said antenna module.

* * * * *